United States Patent [19]

Hazen

[11] 4,092,023

[45] May 30, 1978

[54] SPORT TRAINING DEVICE

[75] Inventor: Mary C. Hazen, Cleveland, Ohio

[73] Assignee: Roe-Mar, Inc., Cleveland, Ohio

[21] Appl. No.: 758,494

[22] Filed: Jan. 11, 1977

[51] Int. Cl.[2] ..... A63B 69/40

[52] U.S. Cl. ..... 273/26 A; 273/55 R; 273/105.2

[58] Field of Search ..... 273/127 R, 102.1 E, 273/105.5, 26 A, 55 R, 105.2, 102.4, 52, 102 R, 102 S, 102 B, 127 RD, 105.6, 181 R, 181 A; 46/32, 191, 118, 155; 272/76, 77, 78

[56] References Cited

U.S. PATENT DOCUMENTS

| | | | |
|---|---|---|---|
| 171,458 | 2/1954 | Peltier | 272/52 |
| 906,392 | 12/1908 | Dietz | 273/102 R |
| 928,674 | 7/1909 | Lenz | 273/102 R |
| 1,099,417 | 6/1914 | Armstrong | 272/76 |
| 1,481,594 | 1/1924 | Fitzgerald | 272/76 |
| 1,493,084 | 5/1924 | Strnsite | 272/52 |
| 3,533,624 | 10/1970 | Miller et al. | 273/55 R |

*Primary Examiner*—Richard C. Pinkham
*Assistant Examiner*—T. Brown
*Attorney, Agent, or Firm*—Fisher, Christen & Sabol

[57] ABSTRACT

A device is disclosed to improve the accuracy of a sport participant in the throwing or kicking of a ball. The device consists of a loop defining an opening through which the ball passes, a stand and a curved, rocking base. The base allows the device to oscillate, thereby providing a moving target to more accurately simulate actual playing conditions.

3 Claims, 3 Drawing Figures

SPORT TRAINING DEVICE

FIELD OF INVENTION

This invention relates to sport training devices, in particular, such devices which improve the throwing or kicking accuracy of the participant.

DESCRIPTION OF THE PRIOR ART

Sport training devices, particularly those for improving the throwing accuracy of a football or baseball, are well-known in the art as evidenced by the following U.S. Pat. Nos. 3,039,770; 1,393,408; 3,680,862; 2,647,747; 3,633,909; 3,341,197; 708,569; and 3,312,467. All of these devices utilize a stationary base and, consequently, do not provide an accurate representation of actual playing conditions, wherein it is frequently necessary to pass, throw, or kick a ball to a moving teammate.

Training devices having oscillating target hoops are also known, as evidenced by U.S. Pat. No. 3,419,272. However, these devices are structurally complex and frequently unreliable in operation. Also, due to their complexity, their cost is relatively expensive, rendering them financially unaffordable at the high school and college level where the neophyte athlete most benefits from their usage.

There are also known, training devices having a curved, rocking type base (U.S. Pat. No. 928,647). However, these bases do not allow the target loop to oscillate in a plane transverse to the path of the thrown or kicked object, but allow the target loop to move in the same direction as the throwing path. Thus, these bases serve as a shock absorbing means to allow the target to move, should it be struck by the thrown object, and not to provide a moving target loop.

SUMMARY OF THE INVENTION

This invention relates to a sport training device for improving the accuracy of an athlete throwing or kicking a ball. The device consists of a generally vertical support having a target loop attached to one end, through which the ball is thrown or kicked, and a curved, rocking base attached to the other end. The rocking base allows the device to oscillate in a plane generally transverse to the path of travel of the ball. The movement of the loop simulates the movement of a target the athlete will encounter under actual playing conditions.

It as an object of this invention to provide such an oscillating sport training device having a relatively simple and durable construction.

It is a further object to provide such a training device having a relatively inexpensive construction.

It is an additional object to provide an oscillating sport training device having a target loop which is adjustable to vary the height of the loop above the base.

It is a further object to provide an oscillating sport training device having interchangeable target loops so that different sized or shaped loops may be used with a given support.

DESCRIPTION OF THE PREFERRED EMBODIMENTS

Figure 1:
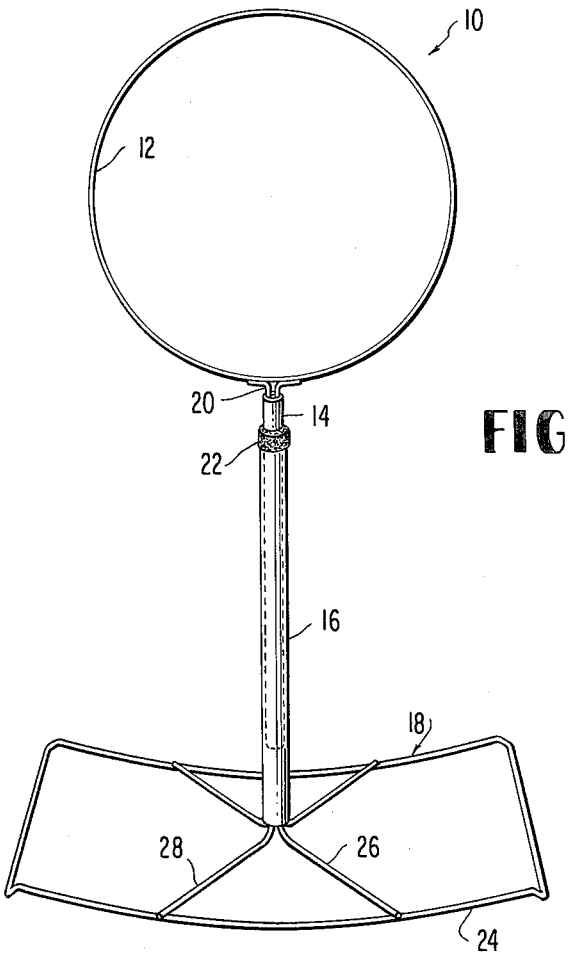
FIG. 1 is a front view of a sports training device according to the invention.
Figure 2:
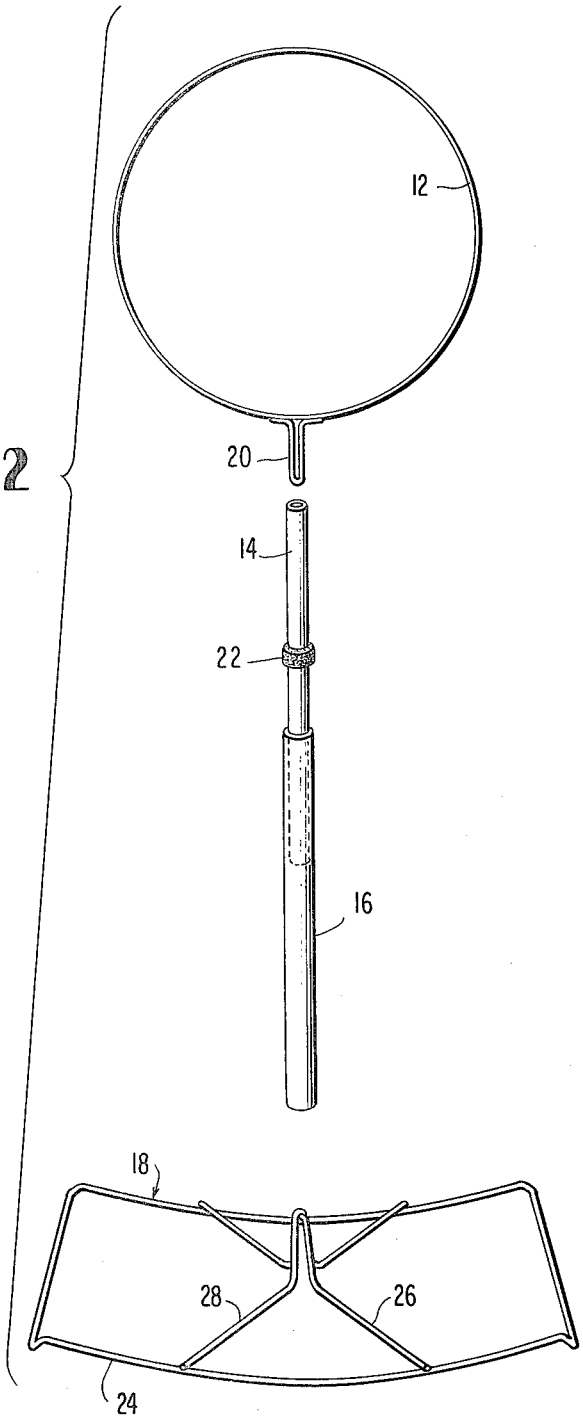
FIG. 2 is an exploded view of the sports training device shown in FIG. 1.

The sports training device according to this invention is shown generally at 10 in FIG. 1. As shown in FIG. 2, it comprises a target loop 12, an inner support member 14, an outer support member 16, and a base structure 18.

The target loop 12 is preferably fabricated from 177 gage steel rod, but any other material possessing the requisite strength may be used. The ends of the wire forming the target loop 12 may be butt welded together to form the closed loop. "U" shaped member 20 is attached to the target loop 12 by any suitable means, such as welding. The width of the "U" shaped member 20 is such that it is slightly narrower than the inside diameter of the inner support member 14 such that it may be inserted therein. The target loop 12 may be permanently fastened to inner support member 14 by any suitable means, or, it may be removably attached to the member 14 by frictional engagement between "U" shaped member 20 and the intesion of inner support member 14. The inner support member 14 may be cut from a length of 18 gage steel pipe, or any other suitable similar material.

The outer support member 16 may also be cut from steel pipe, such as 20 gage or the like. Any material may be used which has the requisite structural rigidity as long as the inside diameter of the outer support member 16 is slightly larger than the outer diameter of the inner support member 14 so as to allow relative sliding movement therebetween.

The relative sliding movement between the inner and outer support members allows the height of the target loop to be adjusted. The target loop is maintained at its adjusted height by washer 22. Washer 22 frictionally engages the outer surface of the inner support member 14, and bears agains the upper end of the outer support member 16. The position of the washer on the inner support 14 may be manually adjusted to alter the height of the target loop. The washer 22 may be made of hard rubber or any other suitable material.

The base 18 comprises a peripheral member 24, and cross members 26 and 28, which may be of 192 gage steel rod or the equivalent. The ends of the cross members 26 and 28 are bent upwardly so as to fit into the lower portion of outer support member 16. Outer support member 16 is fastened to the cross members 26 and 28 by any suitable means.

Thus, as shown in FIG. 1, when the components are assembled and the height of the target loop 12 is adjusted to the desired level, a manual impartation of motion will cause the target loop to oscillate in a plane generally transverse to the path of travel of the thrown object.

The moving target loop can be used to improve the throwing accuracy for football and baseball; the passing accuracy for basketball; and kicking accuracy for soccer.

Figure 3:
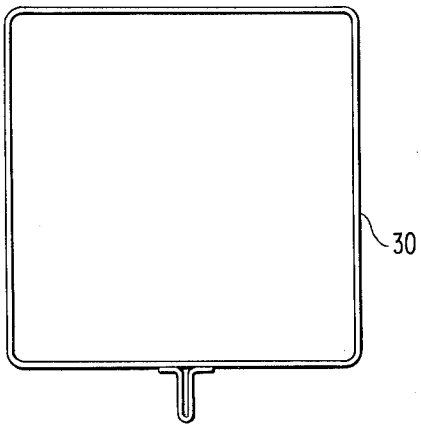
FIG. 3 is a front view of an alternative embodiment of the target loop of a sports training device according to the invention.

Although a circular target loop is shown in FIGS. 1 and 2, the differing requirements of various sports may necessitate a generally square target loop 30 shown in FIG. 3. The construction of the loop 30 and its attachment to the inner support is the same as that previously described except for the shape of the loop.

The scope of this invention is to be determined by the appended claim and not limited to the foregoing description and drawings which are illustrative.

I claim:

1. A sport training device for improving the accuracy of a thrown or kicked object comprising;

a. a target loop through which the object is thrown or kicked;

b. a support attached to said target loop said support being adjustable so as to vary the vertical height of said target loop; and c. a curved, rocking base attached to said support, said base oriented to allow the target loop and support to oscillate in a plane generally transverse to the path of travel of the thrown or kicked object.

2. The sport training device of claim 1 wherein the target loop is removably attached to the support.

3. The sport training device of claim 1 wherein the adjustable support comprises;

a. an outer hollow tube having a lowermost end attached to the base;

b. an inner hollow tube concentrically disposed within said outer hollow tube so as to be slidable with respect thereto, one end of said inner hollow tube being attached to said target loop; and c. means to prevent the relative sliding between the inner and outer hollow tubes to retain the support at its adjusted height.

* * * * *